US008283304B2

(12) United States Patent
Saint Victor

(10) Patent No.: US 8,283,304 B2
(45) **Date of Patent: *Oct. 9, 2012**

(54) GREEN COMPOSITIONS CONTAINING SYNERGISTIC BLENDS OF SURFACTANTS AND LINKERS

(75) Inventor: Marie-Esther Saint Victor, Glencoe, IL (US)

(73) Assignee: S.C. Johnson & Son, Inc., Racine, WI (US)

( * ) Notice: Subject to any disclaimer, the term of this patent is extended or adjusted under 35 U.S.C. 154(b) by 5 days.

This patent is subject to a terminal disclaimer.

(21) Appl. No.: 12/579,111

(22) Filed: Oct. 14, 2009

(65) Prior Publication Data

US 2010/0144582 A1 Jun. 10, 2010

(51) Int. Cl.

| | |
|---|---|
| ***C11D 1/02*** | (2006.01) |
| ***C11D 1/66*** | (2006.01) |
| ***C11D 1/83*** | (2006.01) |
| ***C11D 3/22*** | (2006.01) |
| ***C11D 3/43*** | (2006.01) |

(52) U.S. Cl. ..... 510/426; 510/238; 510/243; 510/474; 510/492; 510/535

(58) Field of Classification Search ..... 510/238, 510/243, 426, 474, 492, 535

See application file for complete search history.

(56) References Cited

U.S. PATENT DOCUMENTS

| | | | |
|---|---|---|---|
| 5,164,116 | A | 11/1992 | Berkhof et al. |
| 5,298,242 | A | 3/1994 | Vanlerberghe et al. |
| 5,342,534 | A | 8/1994 | Skrobala et al. |
| 5,431,840 | A | 7/1995 | Soldanski et al. |
| 5,449,763 | A | 9/1995 | Wulff et al. |
| 5,466,746 | A | 11/1995 | Geck et al. |
| 5,480,586 | A | 1/1996 | Jakubicki et al. |
| 5,489,393 | A | 2/1996 | Connor et al. |
| 5,531,938 | A | 7/1996 | Erilli |
| 5,565,146 | A | 10/1996 | Jakubicki et al. |
| 5,578,250 | A | 11/1996 | Thomas et al. |
| 5,602,093 | A | 2/1997 | Haerer et al. |
| 5,736,503 | A | 4/1998 | Vinson |
| 5,741,769 | A | 4/1998 | Erilli |
| 5,759,979 | A | 6/1998 | Schmid et al. |

(Continued)

FOREIGN PATENT DOCUMENTS

DE 19918189 A1 10/2000

(Continued)

OTHER PUBLICATIONS

PCT/US2010/002748 International Search Report dated Jan. 26, 2011.

*Primary Examiner* — Brian P Mruk

(57) ABSTRACT

Cleaning compositions in the form of nano- or micro-emulsions and containing one or more green surfactants are disclosed. The composition may further include one or more green linkers. The presence of two or more green surfactants may synergistically improve the cleaning performance of the composition. Moreover, the presence of the one or more green linkers may also synergistically improve the soil removal or streak reduction performance of the composition. The composition may further include additional natural actives, such as natural fragrances, natural insecticides, natural insect repellants, and natural oils to provide prolonged release of the natural actives in a controlled manner. The green surfactants not only improve the ecological profile of the disclosed compositions but also allow the formation of stable micro- or nano-emulsions at room temperature with good cleaning performances.

9 Claims, 6 Drawing Sheets

U.S. PATENT DOCUMENTS 5,780,416 A 7/1998 Kiewert et al.
5,807,816 A 9/1998 Cottrell et al.
5,811,386 A 9/1998 Mueller et al.
5,856,290 A 1/1999 Van Buskirk et al.
5,882,541 A 3/1999 Achtmann
5,912,222 A 6/1999 Thomas et al.
5,962,396 A 10/1999 Pollack et al.
5,962,399 A 10/1999 Wulff et al.
6,004,920 A 12/1999 Pollack et al.
6,043,203 A 3/2000 Urfer et al.
6,051,542 A 4/2000 Pollack et al.
6,051,615 A 4/2000 Gross et al.
6,083,517 A 7/2000 Ananthapadmanabhan et al.
6,121,227 A 9/2000 Meine et al.
6,242,593 B1 6/2001 Bloembergen et al.
6,291,419 B1 9/2001 D'Ambrogio et al.
6,353,034 B1 3/2002 Amalric et al.
6,384,010 B1 5/2002 Wagers
6,407,051 B1 6/2002 Smith et al.
6,441,037 B1 8/2002 Arvanitidou et al.
6,593,284 B2 7/2003 Arvanitidou et al.
6,593,288 B2 7/2003 Aubay et al.
6,596,675 B2 7/2003 Maubur et al.
6,605,579 B1 8/2003 Arvanitidou et al.
6,767,410 B2 7/2004 Aubay et al.
6,820,626 B1 11/2004 Jonke et al.
6,864,222 B1 3/2005 Manske
6,927,240 B2 8/2005 Schmid et al.
6,930,081 B1 8/2005 Lu et al.
6,989,149 B2 1/2006 Glenn, Jr. et al.
6,995,128 B2 2/2006 Mitra et al.
6,995,130 B2 2/2006 Manske
7,153,516 B2 12/2006 Bowen-Leaver et al.
7,166,563 B2 1/2007 Woodhead
7,250,174 B2 7/2007 Lee et al.
7,271,136 B2 9/2007 Britton
7,288,514 B2 10/2007 Scheuing et al.
7,396,808 B1 7/2008 Hood et al.
7,414,016 B1 8/2008 Van Buskirk et al.
7,465,700 B1 12/2008 Ochomogo et al.
7,470,331 B1 12/2008 Van Buskirk et al.
7,608,573 B1 10/2009 Scheuing et al.
7,618,931 B1 * 11/2009 Scheuing et al. ..... 510/340
2002/0165287 A1 11/2002 Amalric et al.
2003/0211066 A1 11/2003 Scholz et al.
2005/0197277 A1 * 9/2005 Gallagher et al. ..... 510/475
2006/0009369 A1 1/2006 Kilkenny et al.
2006/0024258 A1 2/2006 Fack et al.
2006/0128591 A1 * 6/2006 Albrecht et al. ..... 510/438
2007/0099807 A1 * 5/2007 Smith et al. ..... 510/180
2007/0259802 A1 11/2007 Heintz et al.
2007/0281039 A1 12/2007 Death
2008/0003185 A1 1/2008 Valpey et al.
2008/0017068 A1 1/2008 Sokol et al.
2008/0044444 A1 2/2008 Tamarkin et al.
2008/0318831 A1 12/2008 Hood et al.
2009/0023620 A1 1/2009 Ochomogo et al.
2009/0042758 A1 2/2009 Molenda et al.
2009/0054294 A1 2/2009 Theiler et al.
2010/0144584 A1 6/2010 Saint Victor

FOREIGN PATENT DOCUMENTS

WO 2006071069 A1 7/2006
WO 2008061375 A1 5/2008
WO 2009024747 A2 2/2009

* cited by examiner

GREEN COMPOSITIONS CONTAINING SYNERGISTIC BLENDS OF SURFACTANTS AND LINKERS

BACKGROUND

1. Technical Field

Eco-friendly, or "green," compositions that include "green" surfactants, "green" linkers, natural fragrances, natural insecticides, and other natural organic actives such as natural oils are disclosed. The composition may be used as a natural cleaning product with performance comparable to conventional cleaning products with less desirable ecological profiles. The composition may also be used to deliver organic actives over a long period of time.

2. Description of the Related Art

In recent years, there has been a significant amount of global consumer awareness in "green", i.e., eco-friendly, household or personal care products. As a result, increasing efforts have been directed to the development of household products with desirable ecological profiles. For example, products containing ingredients that are derived from natural and renewable sources, as well as products that are biodegradable in natural environments, have been a focus of this global "eco-friendly" trend.

Indeed, products derived from renewable resources, such as plants, contribute less greenhouse gas because of their closed $CO_2$ cycle. Specifically, during growth, plants consume the same amount of carbon dioxide ($CO_2$) and water ($H_2O$) as they subsequently release into the atmosphere by biodegradation after use. Therefore, products derived from renewable resources, such as plants, are considered to be "green" and having zero or reduced "carbon footprint" when compared with petrochemical-based products. Common ingredients in household products such as surfactants, fragrances, oils and solvents can be derived directly or indirectly from both renewable sources such as plant materials or non-renewable sources such as petroleum.

The basic way in which surfactants act is determined by their structure. With a hydrophilic head and hydrophobic tail, surfactant molecules become interposed between water and water-insoluble substances such as oil, dirt and grease, collectively referred to as "soil particles." By enriching themselves at the boundaries which water forms with air or oil, surfactants lower the surface tension of the water. When dissolved in water at higher concentrations, surfactant molecules group themselves together to form spherical structures around soil particles referred to as micelles. The inwardly directed hydrophobic groups surround soil particles and keep the otherwise insoluble soil particles in solution. Surfactants are generally classified as being anionic, cationic, non-ionic or amphoteric surfactants depending on the type and charge of the hydrophilic groups.

While most surfactants are still derived from petroleum chemicals, surfactants derived from plant-based carbohydrates and oils are becoming available. One suitable renewable raw material for surfactant production is glucose, which is reacted with alcohol to produce alkyl polyglycosides (also known as alkyl polyglucosides). Alkyl polyglycosides have been used in cosmetics products, agricultural formulations and as surfactants in industrial cleaning agents. Alkyl polyglycosides include a hydrophobic (or lipophilic) hydrocarbon chain is formed by a fatty alcohol (e.g., dodecanol, tetradecanol) obtained from a saturated tropical oils such as palm or coconut oil. The hydrophilic part of the molecule, derived from glucose or dextrose, maybe obtained from starch, most commonly from corn.

In addition to its desirable ecological profile, alkyl polyglycosides have good compatibility with the eyes, skin and mucous membranes and even reduce the irritant effects of surfactant combinations. Alkyl polyglycosides are also completely biodegradable, both aerobically and anaerobically.

Some anionic surfactants may also have immediate precursors that are obtainable from natural and renewable sources. For example, long-chain alkyl sulfates may be conveniently prepared from fatty alcohols derived from coconut oils. In particular, sodium coco sulfate (SCS) is derived from pure coconut oil and includes a mixture of sodium alkyl sulfate with the main component being sodium lauryl sulfate. Sodium coco sulfate may be used in a wide variety of consumer products in which viscosity building and foam characteristics are of importance. It can be incorporated into shampoos, hand soaps, bath products, shaving creams and medicated ointments.

In formulating micro- or nano-emulsion, linkers may be used to facilitate the interactions among water phase, oil phase, and surfactant(s). Specifically, lipophilic linkers may enhance the surfactant-soil interaction whereas hydrophilic linkers may enhance the surfactant-water interaction. Like surfactants, "green" linkers derived from natural and renewable sources are becoming available, although traditionally they are derived from petroleum chemicals.

Compositions for controlled release of active substances are also known in the art. For example, fragrance or insecticide compositions in the form of single-phase solution have been developed to allow prolonged release of a fragrance or insecticide into the air. However, those compositions generally have a less desirable ecological profile in order to maintain their fragrance or insecticide delivery performance.

Thus, there is a need for improved household products derived from natural, renewable sources such as plants or that have a higher percentage of components that are derived from natural, renewable sources. Moreover, there is a need for a cleaning product with an improved ecological profile and performance that is comparable, or even superior, to conventional cleaning products with less desirable ecological profiles. Finally, there is a need for a "green" composition that allows a controlled release of a natural organic active such as a fragrance or insecticide.

SUMMARY OF THE DISCLOSURE

In satisfaction of the aforementioned needs, compositions in the form of nano- or micro-emulsions and containing one or more "green" surfactants are disclosed. The composition may further include other "green" ingredients such as "green" linkers, natural fragrance, etc.

As used in this disclosure, a "green" ingredient is defined as a substance that is obtainable from natural and renewable sources or is prepared from immediate precursor(s) obtainable from natural and renewable sources.

As used herein, the term "Natural Index" (NI) is the weight percentage of the composition that includes ingredients that are either directly obtainable from natural and renewable sources or made from immediate predecessors that are directly obtainable from natural and renewable sources.

For example, ingredients such as water, ethanol, lactic acid, citric acid, caustic soda, natural fragrances, are both green and contribute to the NI of a disclosed composition because each is obtainable from natural and renewable sources. Similarly, compounds like alkyl polyglycosides, alkyl glucoside, sodium coco sulfate (sodium lauryl sulfate) as disclosed herein are both green and contribute to the NI of a disclosed composition because each may be made from immediate precursors (fatty alcohols, glucose, etc.) that are obtainable from natural and renewable sources. On the other hand, surfactants such as ethoxylated nonionic surfactants, alkylbenzene sulfonate anionic surfactants, and quaternary ammonium cationic surfactant are based on petroleum chemicals and thus are not green as defined herein and do not contribute toward the NI of the composition.

In one embodiment, the disclosed composition is a cleaning composition that includes a green nonionic surfactant, one or more green co-surfactants, and water. In a refinement, the green nonionic surfactant may include an alkyl polyglycoside and the green co-surfactants may include an anionic surfactant such as sodium lauryl sulfate or sodium coco sulfate. The combination of green surfactants may synergistically improve cleaning performance of the composition.

In another embodiment, the disclosed composition is a cleaning composition that includes one or more green surfactants, one or more green linkers, and water. In a refinement, the one or more green surfactants may be nonionic, anionic, or a mixture of both. In another refinement, the one or more green linkers may be lipophilic or hydrophilic linkers selected from the group consisting of glucosides, alkanols, esters, and mixtures thereof The combination of the green surfactant(s) and the green linker(s) may synergistically improve soil-removal performance of the cleaning composition. Moreover, when used as a glass cleaner, the disclosed composition may have less streaking than conventional glass cleaning products.

In a further embodiment, the disclosed composition is an active delivery composition that includes one or more green surfactants, one or more natural actives, and water. In a refinement, the one or more green surfactants may be nonionic, anionic, or a mixture of both. In another refinement, the one or more natural actives may be selected from the group consisting of natural fragrances, natural insecticides, natural oils, and mixtures thereof The combination of the green surfactant (s) and the natural active(s) allows for an improved release of the actives without sacrificing the ecological profile of the composition.

The green surfactant(s) and other green ingredients of the disclosed composition may not only improve the ecological profile of the compositions but also allow spontaneous formation of stable micro- or nano-emulsions at room temperature. It is contemplated that the presence of the disclosed composition as micro- or nano-emulsions, rather than solutions or conventional emulsions, may contribute to the enhanced performance of the composition.

Performance of the disclosed composition, such as soil removal or streak reduction, are evaluated through various comparison tests between the disclosed composition and one or more leading commercial products with less desirable ecological profiles, i.e. with lower Natural Index than the disclosed composition. As discussed in greater detail below, the performance of the disclosed composition is at least comparable to, and in some cases better than, the leading commercial products.

Other advantages and features of the disclosed methods and compositions will be described in greater detail below. It will also be noted here and elsewhere that the disclosed green compositions may be suitably modified to be used in a wide variety of household applications by one of ordinary skill in the art without undue experimentation.

BRIEF DESCRIPTION OF THE DRAWINGS

For a more complete understanding of the disclosed compositions, reference should be made to the embodiments illustrated in greater detail in the accompanying drawings, wherein.

Figure 1:
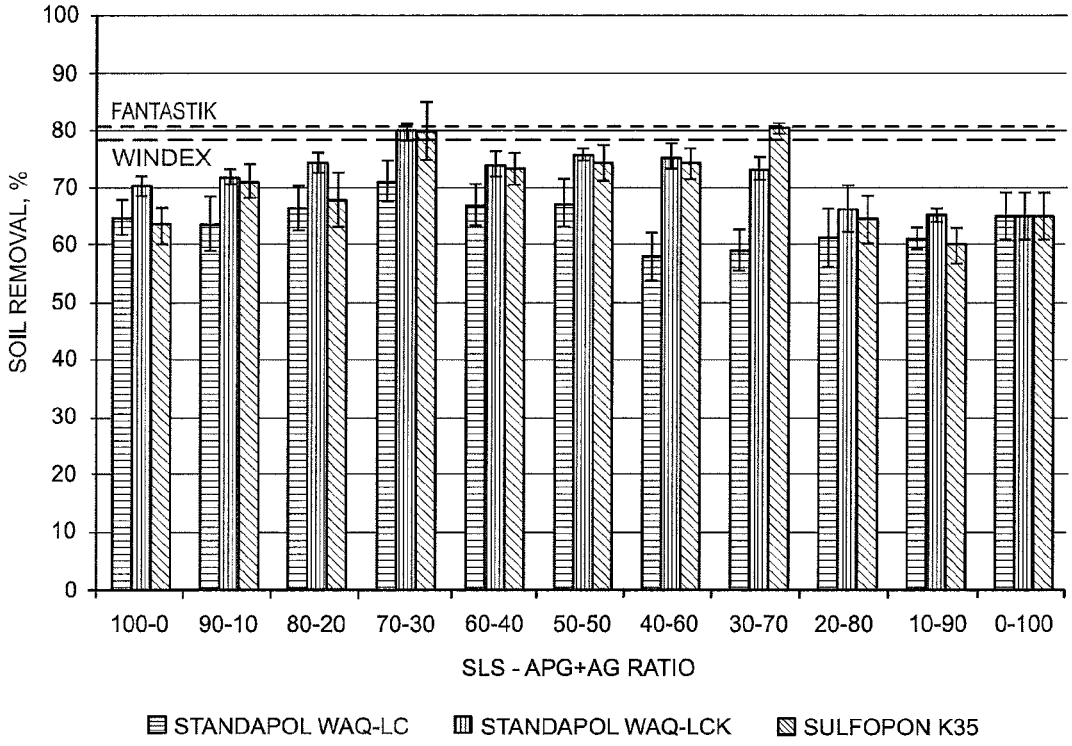
FIG. 1 graphically illustrates the synergistically improved soil removal performance of cleaning compositions that include the green surfactants blend.

It should be understood that the drawings are not necessarily to scale and that the disclosed embodiments are sometimes illustrated diagrammatically and in partial views. In certain instances, details which are not necessary for an understanding of the disclosed composition or which render other details difficult to perceive may have been omitted. It should be understood, of course, that this disclosure is not limited to the particular embodiments illustrated herein.

DETAILED DESCRIPTION OF THE PRESENTLY PREFERRED EMBODIMENTS

This disclosure is generally related to an eco-friendly liquid compositions or emulsions. To evaluate the ecological profile a composition or emulsion, the term "Natural Index" (NI) is used herein to refer to the weight percentage of the composition that includes ingredients that are either directly obtainable from natural and renewable sources or made from immediate predecessors that are directly obtainable from natural and renewable sources. Similarly, a "green" ingredient is defined as a substance that is obtainable from natural and renewable sources or is prepared from immediate precursor(s) obtainable from natural and renewable sources. For example, ingredients such as water, ethanol, lactic acid, citric acid, caustic soda, natural fragrances, are all obtainable from natural and renewable sources while synthetic fragrances are not. Similarly, compounds like alkyl polyglycosides, alkyl glucoside, sodium coco sulfate (sodium lauryl sulfate) disclosed herein may be made from immediate precursors (fatty alcohols, glucose, etc.) that are obtainable from natural and renewable sources. On the other hand, surfactants such as ethoxylated nonionic surfactants, alkylbenzene sulfonate anionic surfactants, and quaternary ammonium cationic surfactant are based on petroleum chemicals, are therefore not green and do not contribute toward the NI of a composition.

In a general embodiment, the disclosed green composition is aqueous-based and may include a green nonionic surfactant that is made from immediate precursors that are obtainable from natural and renewable sources. The composition may also include one or more secondary green ingredient selected from the group consisting of a fragrance, a hydrophilic linker, a lipophilic linker, a co-surfactant, an insecticide, an insect repellant, and an oil. In some embodiments, the disclosed composition may also include an organic solvent, while in other embodiments, the composition is essentially free of organic solvents. Further the composition may include optional adjuvants such pH adjusting agents, organic acids, and the like.

Green Surfactants

The green nonionic surfactants of the disclosed composition may include, but are not limited to, sugar-based surfactants, polyol-based surfactants, alkyl ethers, and alkyl carbonates. The sugar-based surfactants may be alkyl polyglycoside (or alkyl polyglucoside) surfactants that are made from fatty alcohols in coconut oil and polyglucose in corn. In addition to its excellent ecological profile, alkyl polyglycosides are biodegradable, non-irritating to human skin, and effective in solubilizing fragrance oil in water.

The alkyl polyglycosides which can be used in the disclosed emotions correspond to the following formula I:

$$R_1O(Z)_a$$

wherein $R_1$ is a monovalent organic radical having from about 4 to about 22 carbon atoms; Z is a saccharide residue having 5 or 6 carbon atoms; and a is a number having a value from 1 to about 6. For example, alkyl polyglycosides of formula I wherein Z is a glucose residue. Such alkyl polyglycosides are commercially available, for example, as APG®, GLUCOPON®, or PLANTAREN® surfactants from Cognis, 5051 Estecreek Drive, Cincinnati, Ohio 45232.

Suitable alkyl ethers used as green surfactants in the disclosed composition may include ethers with $C_4$-$C_{22}$ alkyl chains on either side of the C—O—C bond ($R_1$—O—$R_2$). The alkyl chains ($R_1$, $R_2$) may be saturated or unsaturated. In one embodiment, the alkyl ether may be dicaprylyl ether.

Suitable alkyl carbonates used as green surfactants in the disclosed composition may include carbonates with $C_4$-$C_{22}$ alkyl chains on either side of the carbonate group

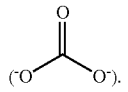

The alkyl chains may be saturated or unsaturated. In one embodiment, the alkyl ester may be dicaprylyl carbonate.

Other nonionic green surfactants suitable for use in the disclosed composition may include, but are not limited to, alkyl glucose amide, triglycerides, N-methyl coconut fatty acid glucamides (C12-14), amino acid-based surfactants, sugar esters, sorbital esters, sterol esters, glycolipid biosurfactants, etc.

In one embodiment, the disclosed composition may include from 0.000001 to 4 wt % green nonionic surfactant (s). In another embodiment, the green nonionic surfactants) may be included at a level of from 0.000001 to 3 wt %. In some embodiments in which one or more additional green ingredients are added to the composition to synergistically improve its performance, the concentration of the green nonionic surfactant(s) may be reduced to no more than 1 wt %, no more than 0.5 wt % or even no more than 0.25 wt %.

In addition to the green nonionic surfactant, the disclosed composition may optionally include one or more green anionic surfactants. The green anionic surfactants may also be prepared from immediate precursors that are obtainable from natural and renewable sources. In one embodiment, the green anionic surfactants include one or more long-chain alkyl sulfates. Suitable alkyl sulfates includes, but are not limited to, sodium $C_8$-$C_{20}$ sulfates, ammonium $C_8$-$C_{20}$ sulfates, and mixtures thereof.

In a preferred embodiment, the green anionic surfactant includes sodium coco sulfate or sodium lauryl sulfate. Sodium coco sulfate may be prepared from sulfating coconut oil, which is made up of a wide range of fatty acids (ranging from as few as 8 carbon alkyl chains to as many as 20). The majority, e.g. 45-50%, of the fatty acids in coconut oil are fatty acids containing 12 carbons. Sodium lauryl sulfate, on the other hand, is a purified version of the sodium coco sulfate. During manufacturing of sodium lauryl sulfate, coconut oil is processed to remove most of the non-12 carbon fatty acids before the fatty acids are sulfated.

The green anionic surfactant may be used in the disclosed composition to synergistically improve the performance, such as soil removal, of the composition. Accordingly, a relatively low level of the green anionic surfactant is required. For example, the concentration of the green anionic surfactant(s) may be from 0.000001 to 1 wt %, from 0.000001 to 0.5 wt % or even from 0.000001 to 0.25 wt %. In some embodiment, the total surfactant level of the disclosed composition may be no more than 2.5 wt %, 1.0 wt %, 0.5 wt %, or even 0.1 wt %. In one embodiment, a synergistic blend of green nonionic and anionic surfactant achieves effective soil removal at a low total surfactant concentration of 0.01 wt %.

It is to be understood that although some preferred embodiments of this disclosure use only green surfactants, other embodiments may include a combination of green and non-green surfactants (e.g. synthetic surfactants) or may even include only non-green surfactants so long as the quantity of the non-green surfactants does not significantly lower the Natural Index of the disclosed composition.

Green Linkers

The disclosed composition may optionally include one or more green linkers. The green linkers may be lipophilic or hydrophilic. Suitable lipophilic and hydrophilic linkers may include, but are not limited to, oleates (e.g., glycerol monooleate (GMO), glyceryl oleate, etc.), stearates (e.g., glycerol monostearate (GMS)), polysorbates (e.g., sorbitan monolaurate (SML)), alkanols, glucosides, esters, glycerin and mixtures thereof.

For example, the lipophilic linker may include one or more C12-18 alkanol. In one embodiment, the one or more alkanols may be selected from the group consisting of lauryl alcohol, cetyl alcohol, myristic alcohol, and mixtures thereof. The alkanols may be made from immediate predecessors that are obtainable from natural and renewable sources. In particular, lauryl alcohol may be made from fatty acids in coconut oils; cetyl alcohol may be made from spermaceti, a waxy substance obtained from sperm whale oil; and myristic alcohol may be made from myristic acid, which is found in palm oil, coconut oil, butter fat, and spermaceti.

Similarly, the hydrophilic linker may also be made from immediate predecessors that are obtainable from natural and renewable sources. Suitable hydrophilic linkers may include one or more alkyl glucoside such as hexyl glucoside. The hexyl glucoside used in the disclosed composition is commercially available (as "AG 6206") from Akzo Nobel, 525 W. Van Buren Street, Chicago, Ill. 60607-3823. The hydrophilic part of the hexyl glucoside, derived from glucose or dextrose, may be obtained from starch, most commonly from corn.

The green lipophilic and/or hydrophilic linkers may be used in the disclosed composition to synergistically improve the performance, such as soil removal and/or streak reduction, of the composition. As a result, relatively low levels of the green linkers are required. In one embodiment, the disclosed composition may include from 0.000001 to no more than 2 wt % green linker(s). In another embodiment, the green linker(s) may be included at a level of from 0.000001 to 1 wt %, 0.000001 to 0.5 wt % or 0.000001 to 0.1 wt %. In some embodiments in which one or more green linkers are added to the composition to synergistically improve its performance, the concentration of the green linker(s) may be reduced to no more than 0.05 wt % or even no more than 0.025 wt %.

Without wishing to be bound by any particular theory, linker molecules are added to the disclosed composition to enhance the interaction between the surfactant and oil (lipophilic linkers) or water (hydrophilic linkers) phases, where the lipophilic and hydrophilic linkers are combined to behave as a self-assembled surfactant at the oil/water interface to facilitate the formation of a stable micro- or nano-emulsion. Further, the efficiency of the self-assembly may be dependent on the ratio of the green surfactants and the green linkers, the total concentration of the surfactants and/or linkers, or both. In some embodiments, the self-assembly between hydrophilic and lipophilic linkers to facilitate the formation of micro- or nano-emulsions may require the presence of only a small amount of linkers, such as no more than 0.1 wt %, 0.05 wt %, or even 0.01 wt %. In one embodiment, effective soil removal is achieved by a composition using linkers at a total concentration of 0.0012 wt % or 0.0024 wt %.

Again, although some preferred embodiments of this disclosure use only green linkers, other embodiments may include a combination of green and non-green linkers (e.g. synthetic linkers) or may even include only non-green linkers so long as the quantity of the non-green linkers does not significantly lower the Natural Index of the disclosed composition.

Natural (Green) Fragrances

The disclosed composition may include one or more fragrances derived in from natural and renewable sources such as plants or crops. In addition, the composition may deliver the natural fragrances into the air in a controlled manner over a long period of time. To that end, the presence of the composition as micro- or nano-emulsions may facilitate the consistent release of the fragrances.

For example, the disclosed composition may include a natural fragrance for air freshening. The natural fragrance freshens air either by masking one or more malodors therein or by imparting a pleasant smell to the air, or both. As is well known, a fragrance normally consists of a mixture of a number of fragrant materials, each of which has a particular fragrance. The number of fragrant materials in a fragrance is typically ten or more. The range of fragrant materials used may vary. The materials come from a variety of chemical classes, but in general are water-insoluble oils. In many instances, the molecular weight of a fragrance material is in excess of 150, but does not exceed 300.

The natural fragrance included in the disclosed composition may be present in an amount that is sufficient to impart a pleasant smell to the air that can be perceived by a consumer. In the presence of a malodor, the natural fragrance may be present in an amount that masks at least a substantial portion of the malodor in the air. More preferably, the natural fragrance included in the disclosed composition may be present in an amount that not only completely masks the malodors therein, but also delivers a pleasant smell to be perceived by a consumer.

The natural fragrance may be present in the disclosed composition in an amount of from 0.0001 to 1 wt %, more preferably from 0.01 to 0.5 wt % and most preferably from 0.02 to 0.2 wt %. In one embodiment, the composition includes 0.05 wt % natural fragrance. In another embodiment, the composition includes 0.15 wt % natural fragrance. The amount of the fragrance that is needed to mask the malodor(s) therein, and/or the amount of the fragrance to impart the pleasant smell to be perceived by the consumer will be apparent to one of ordinary skill in the art.

The fragrance according to this disclosure may comprise one or more fragrant materials or materials that provide chemically active vapors. In one embodiment, the fragrance can comprise and/or include volatile, fragrant compounds including, but not limited to natural botanic extracts, essences, fragrance oils, and so forth. As is known in the art, many essential oils and other natural plant derivatives contain large percentages of highly volatile scents. In this regard, numerous essential oils, essences, and scented concentrates are commonly available from companies in the fragrance and food businesses.

Exemplary oils and extracts include, but are not limited to, those derived from the following plants: almond, amyris, anise, armoise, bergamot, cabreuva, calendula, canaga, cedar, chamomile, coconut, eucalyptus, fennel, jasmine, juniper, lavender, lemon, orange, palm, peppermint, quassia, rosemary, thyme, and so forth.

Fragrances can also be made of organic compounds derived from floral materials and fruits. Examples of suitable organic compounds include, but are not limited to, dimyrcetol, phenylethyl alcohol and tetrahydromuguol, decyl aldehyde, undecyl aldehyde, undecylenic aldehyde, lauric aldehyde, amyl cinnamic aldehyde, ethylmethyl phenyl glycidate, methyl nonyl acetaldehyde, myristic aldehyde, nonalactone, nonyl aldehyde, octyl aldehyde, undecalactone, hexyl cinnamic aldehyde, benzaldehyde, vanillin, heliotropine, camphor, parahydroxyphenolbutanone, 6-acetyl-1,1,3,4,4,6-hexamethyl tetrahydronaphthalene, alpha-methyl ionone, gamma-methyl ion-one, and amyl-cyclohexanone and mixtures thereof.

It is to be understood, of course, that the type, strength, and odor profile of the fragrance suitable for use in the disclosed aerosol composition would be apparent to one of ordinary skill in the art and therefore should not be considered as limiting the scope of this disclosure. Further, although some preferred embodiments of this disclosure use only natural fragrances, other embodiments may include a combination of natural and synthetic fragrances or may even include only synthetic surfactants so long as the quantity of the synthetic surfactants does not significantly lower the Natural Index of the disclosed composition.

Natural (Green) Insecticides/Insect Repellents

The disclosed composition may include one or more insecticides and/or one or more natural insect repellants derived in from natural and renewable sources. In addition, the composition may deliver the natural insecticide and/or insect repellant into the air in a controlled manner over a long period of time. To that end, the presence of the composition as micro- or nano-emulsions may facilitate the consistent release of the natural insecticide and/or insect repellent.

The natural insecticide or insect repellant used in the disclosed composition may have low toxicity to human or household pets. Suitable natural insecticides for used in the disclosed composition may include, but are not limited to, pyrethrum (an insecticide derived from the flowers of a species of chrysanthemum), nicotine (a tobacco extract used primarily for piercing-sucking insects such as aphids, whiteflies, leafhoppers and thrips), sabadilla (obtained from the seeds of a lily-like plant and acts as both a contact and stomach poison for insects), rotenone (extracted from the roots of derris plants in Asia and cube plants in South America), and neem oil (an extract from the neem tree, azadirachta indica, a native to Southeast Asia and found in many countries throughout the world).

Suitable natural insect repellents may be volatile essential oils obtained from plants. For example, the natural insect repellents may include, but are not limited to, citronella oil, lemon eucalyptus oil, cinnamon oil, castor oil, rosemary oil, lemongrass oil, cedar oil, peppermint oil, clove oil, geranium oil, verbena oil, pennyroyal oil, lavender oil, pine oil, cajeput oil, basil oil, thyme oil, allspice oil, soybean oil, garlic oil, ect.

The type, strength, and concentration of the natural insecticide and/or insect repellent suitable for use in the disclosed composition would be apparent to one of ordinary skill in the art and therefore should not be considered as limiting the scope of this disclosure.

Natural (Green) Oils for Prolonged Release of Insecticides/Repellants

The disclosed composition may include one or more oils derived in from natural and renewable sources. In addition, the composition may deliver the natural oils into the air in a controlled manner over a long period of time. To that end, the presence of the composition as micro- or nano-emulsions may facilitate the consistent release of the natural oils.

In one embodiment, the natural oil used in the disclosed composition may include one or more vegetable oils. Suitable natural oils for used in the disclosed composition may include, but are not limited to, palm oil, soybean oil, rapeseed oil, sunflower seed oil, peanut oil, cottonseed oil, palm kernel oil, coconut oil, olive oil, corn oil, hazelnut oil, rice ban oil, safflower oil, sesame oil, linseed oil, castor oil, tung oil, etc.

The type and concentration of the natural oils suitable for use in the disclosed composition would be apparent to one of ordinary skill in the art and therefore should not be considered as limiting the scope of this disclosure.

Green Organic Solvents

In some embodiment, the disclosed composition may optionally include one or more organic solvents. Preferably, the organic solvents used in the composition are derived from natural and renewable sources and thus do not negatively affect the ecological profile, i.e. Natural Index, of the composition. In other embodiments, however, no additional organic solvent is included in the composition. In one embodiment, the composition is VOC-free.

Suitable organic solvents may include one or more monohydric alcohols, preferably low molecular weight monhydric green alcohols derived from natural and renewable sources, e.g. ethanol, propanol, butanol, etc. More specifically, ethanol may be obtained from fermentation of sugar; propanol may be obtained as a by-product of fermentation of sugar; and butanol may be obtained from the fermentation of biomass. As a result, the inclusion of such organic solvent does not lower the Natural Index of the disclosed composition.

In one embodiment, the composition includes 0-5 wt %, and more preferably 0-4% green alcohols. In another embodiment, the composition includes 0.1-3.9 wt % ethanol. It is to be understood that the type and concentration of the green organic solvents suitable for use in the disclosed composition would be apparent to one of ordinary skill in the art and therefore should not be considered as limiting the scope of this disclosure.

Green pH Adjusting Agents

In some embodiment, the disclosed composition may optionally include one or more pH adjusting agents. Preferably, the pH adjusting agents used in the composition are derived from natural and renewable sources and thus do not negatively affect the ecological profile, i.e. Natural Index, of the composition.

Suitable pH adjusting agents may include bases such as sodium hydroxide (manufactured through electrolysis of salt solution), sodium carbonate (naturally occurring as mineral deposits), and sodium bicarbonate (naturally occurring in mineral natron). In addition, the green pH adjusting agents may include one or more organic acids derived from natural or renewable sources. For example, the organic acids may be citric acid (naturally occurring in fruits and vegetables), lactic acid (obtainable from fermentation of milk sugar, cornstarch, or potato), acetic acid (obtainable from fermentation of starch or fruit), etc. The use of lactic or citric acids may also have the benefit of soap scum and lime scale removal. Finally, the green pH adjusting agents may include one or more salts of the aforementioned organic acids, such as sodium citrate, sodium acetate, etc.

Of course, the type and concentration of the green pH adjusting agents suitable for use in the disclosed composition would be dependent on the desired pH of the composition and should be apparent to one of ordinary skill in the art without undue experimentation in light of this disclosure. Further, although some preferred embodiments of this disclosure use only green pH adjusting agents, other embodiments may include a combination of green and non-green pH adjusting agents or may even include only non-green pH adjusting agents so long as the quantity of the non-green pH adjusting agents does not significantly lower the Natural Index of the disclosed composition.

One feature of the disclose composition is its physical presence as a micro- or nano-emulsion. Without being wishing to be bound by any particular theory, it is contemplated that micro- or nano-emulsions of the disclosed green ingredients exhibit improved performance, such as soil removal, streak reduction, or active delivery, of the composition than conventional emulsions, suspensions, or even solutions.

Another feature of the disclosed composition is its high Natural Index. As a result, the composition achieves improved performance without sacrificing the ecological profile thereof. For example, the composition may have a high Natural Index of no less than 95%, 97%, 98%, or even 98.5%. In one embodiment, the disclosed composition has a Natural Index of no less than 99%, 99.5% or 99.8%.

Performance Evaluation

In order to optimize the performance of the disclosed compositions, streak reduction (for glass cleaning compositions) and soil removal (for glass cleaning compositions and bathroom cleaning compositions) are evaluated against a commercial glass cleaner (Windex® cleaning product) and a commercial all-purpose cleaner (Fantastik® cleaning product).

To obtain the Streak or Soil Removal of a cleaning composition, cleaned glass slides or baked enamel tiles are weighed before use. Soil, such as 25-29 milligrams of a lab generated, synthetic, greasy kitchen soil, is applied on the surfaces of the glass slides or enamel tiles. The soiled glass slides or enamel tiles are then cleaned by the cleaning composition to be tested, such as through a Gardner Scrub Machine after 7 strokes, and weighed again. The soil removal performance of a composition is reflected as the percentage of the soil that is removed from the glass slides or enamel tile. The streak reduction performance of a composition is reflected by an index designated hereinafter as "Streak", which is determined by a panel evaluation on a 0 to 5 scale with 0 being the best after a soiled glass is cleaned by a cleaning composition.

Green Surfactants Blend

To investigate the synergy between the green nonionic surfactant and the green co-surfactant, two cleaning compositions comprising a mixture of sodium lauryl sulfate (Standapol® WAQ-LC or Standapol® WAQ-LCK) and Glucopon® 425N and a cleaning composition comprising a mixture of sodium Coco Sulfate (Sulfopon® K 35) and Glucopon® 425N were prepared with total surfactant concentration of 1 wt %. The ratio of the two green surfactants in the cleaning compositions varies from zero to 100 percent. The rest of the ingredients in the three compositions are identical.

As illustrated in FIG. 1, the Standapol WAQ-LC/Glucopon 425N mixture (1 wt % total concentration) has its highest cleaning performance (71.3%) at 70/30 volume ratio while the Standapol WAQ-LCK/Glucopon 425N mixture (1 wt % total concentration) achieves the highest cleaning performance (79.9%) at the same volume ratio. The Sulfopon K 35/Glucopon 425N mixture (1 wt % total concentration), on the other hand, reaches the highest cleaning performance (80.5%) at 30/70 volume ratio. The cleaning performances of the Sulfopon K 35/Glucopon 425N mixture at 30/70 volume ratio and Standapol WAQ-LCK/Glucopon 425N mixture at 70/30 volume ratio are as good as or better than the cleaning performance of the Fantastik® or Windex® cleaning product.

TABLE 1

Optimized Synergistic Green Surfactant Blend for Soil Removal

| Synergistic blends | Blend ratio | Soil Removal (%) |
|---|---|---|
| Water | 0 | 46 |
| Standapol ® WAQ-LC/Glucopon ® 425N | 70/30 | 71.3 |
| Sulfopon ® K35/Glucopon ® 425N | 70/30 | 79.8 |
| Sulfopon ® K35/Glucopon ® 425N | 30/70 | 80.5 |

Further, varying the total surfactant concentration from 0.5% to 2.5% of both synergistic blends (Sulfopon K 35/Glucopon 425N and Standapol WAQ-LC/Glucopon 425N) in the selected range of volume ratio unexpectedly shows insignificant impact on the cleaning performance of the compositions, which may indicate that the total surfactant concentration in the composition may be reduced to even lower levels without affecting cleaning performance thereof.

Figure 2:
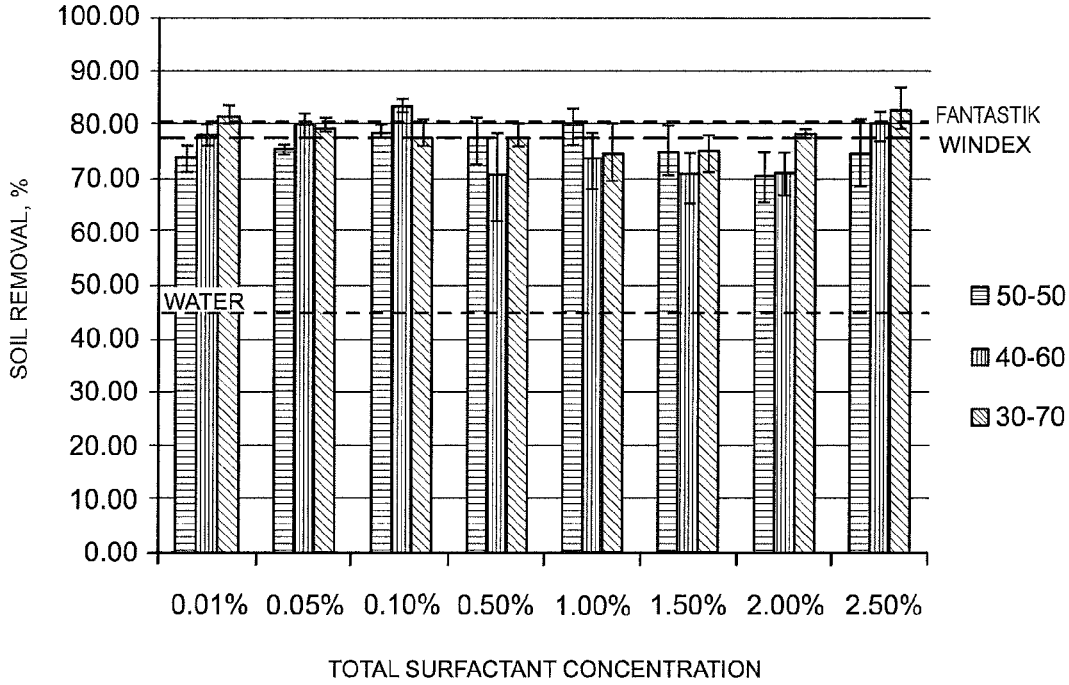
FIG. 2 graphically illustrates the relationship between the soil removal performance and the total surfactant concentration of cleaning compositions that include the green surfactants blend.

As illustrated in FIG. 2, the total surfactant concentration of the green nonionic surfactant and co-surfactant blend may vary between 0.01 and 2.50 wt % without significantly affecting the soil removal performance thereof. In addition, same or similar high level of soil removal performance is maintained throughout the aforementioned concentration range regardless of blend ratio.

As discussed above and without wishing to be bound by any particular theory, the synergistic combination of green nonionic surfactant and co-surfactant improves soil removal by spontaneously emulsifying or solubilizing the soil on a target surface. To that end, emulsifying capacity of the synergistic surfactant blend is determined by preparing a micro-emulsion (8 mL) that includes a green surfactant blend and comparing its ability to emulsify corn oil (2 mL) with the Windex® cleaning product or Fantastik® cleaning product.

To evaluate the emulsification or solubilization capability of the prepared micro-emulsion, interfacial tensions (IFT) between the aqueous composition and corn oil were determined with the spinning drop tensiometer in the dynamic mode at 20 minutes and room temperature, wherein the IFT indicates of the ability of the aqueous composition to emulsify the corn oil. IFTs of both Sulfopon K 35/Glucopon 425N mixture and Standapol WAQ-LC (SLS)/Glucopon 425N mixture are measured against corn oil. The results show synergism in IFT in the SLS-rich region. The range of volume ratio that shows the synergism in Sulfopon K 35/Glucopon 425N mixture is wider than that of Standapol WAQ-LC/Glucopon 425N mixture. It was found that the synergistic blends outperformed both the Windex® cleaning product and Fantastik® cleaning product in solubilizing and emulsifying the corn oil.

Non-limiting exemplary cleaning compositions containing a synergistic blend of green nonionic surfactant and co-surfactant are listed below.

Composition A (Glass Cleaner)

| Function/ Description | Chemical Name/Trade Name | Concentration (wt %) | Natural Index (NI) (%) |
|---|---|---|---|
| Solvent | Water | 95.58-98 | 95.58-98 |
| Organic solvent | Ethanol SDA 40B | 0-3.9 | 0-3.9 |
| Green nonionic surfactant | Alkyl polyglycoside/ Glucopon ® 425N | 0.10-0.32 | 0.10-0.32 |
| Green co-Surfactant | Sodium lauryl sulfate | 0.08-0.32 | 0.08-0.32 |
| pH adjusting agent | Sodium nitrate | 0.05 | 0.05 |
| pH adjusting agent | Caustic soda, 50% (aq) | 0.01 | 0.01 |
| Fragrance | Fragrance | 0.05 | 0.05 |
| | | | 100 |

Composition B (Bathroom Cleaner)

| Function/ Description | Chemical Name/Trade Name | Concentration (wt %) | Natural Index (NI) (%) |
|---|---|---|---|
| Solvent | Water | 93.83 | 93.83 |
| green nonionic surfactant | Alkyl polyglycoside/ Glucopon ® 425N | 0.06-0.24 | 0.06-0.24 |
| green co-Surfactant | sodium lauryl sulfate | 0.06-0.24 | 0.06-0.24 |
| Organic acid | L-lactic acid | 0-3 | 0-3 |
| Fragrance | Fragrance | 0.15 | 0.15 |
| | | | 100 |

Green Surfactant and Green Linkers

To investigate the synergy between the green surfactant and the green linkers, a bathroom or glass cleaning composition (NSB or NSG, respectively) comprising Glucopon® 425N and no green linker and cleaning compositions comprising Glucopon® 425N and one hydrophilic or lipophilic green linker (tetradecanol or hexyl glucoside) are prepared. The concentration of the linkers ranges from 0.01 wt % to 0.50 wt %. The rest of the ingredients in those compositions are identical.

Figure 3:
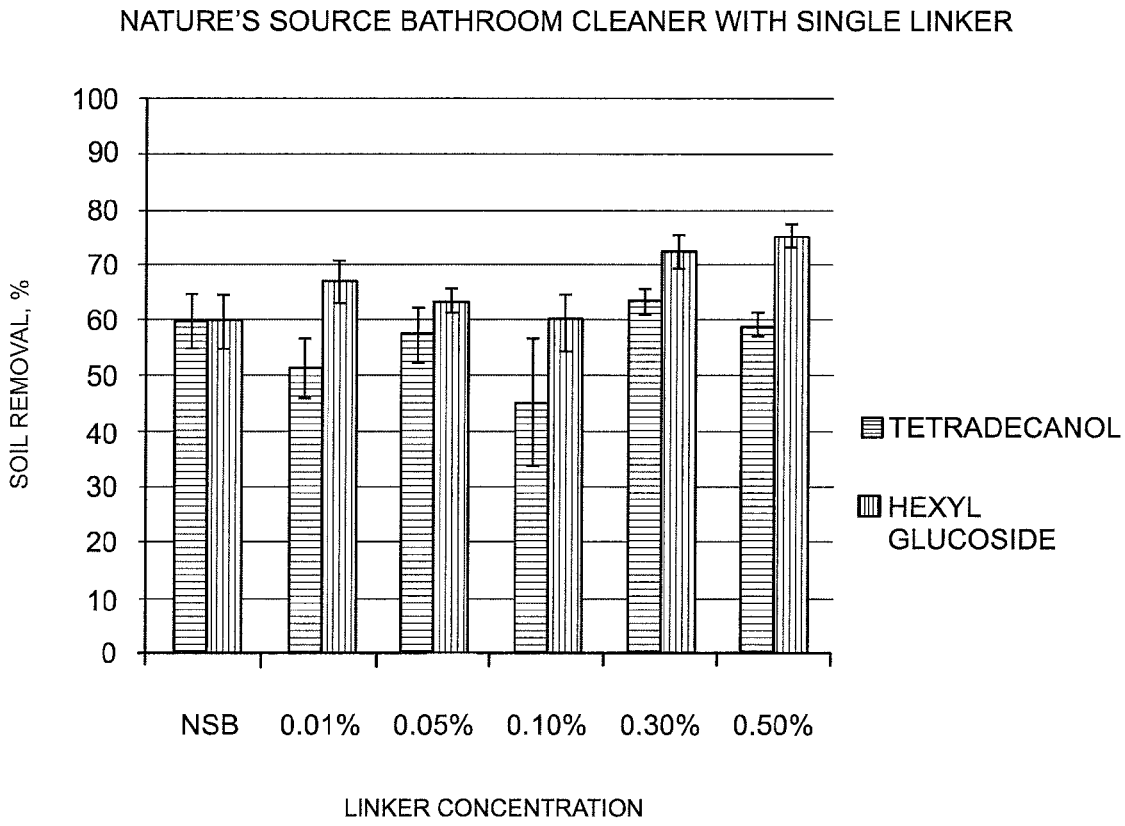
FIG. 3 graphically illustrates the relationship between the soil removal performance and the linker concentration of bathroom cleaning compositions that include only a single linker.

As illustrated in FIG. 3, no significant improvement in soil removal performance of a bathroom cleaning composition is observed with the addition of only the lipophilic linker (tetradecanol) throughout the concentration range. On the other hand, slight improvement is observed with the addition of only the hydrophilic linker (hexyl glucoside) at a concentration of 0.3 wt % or higher.

Figure 4:
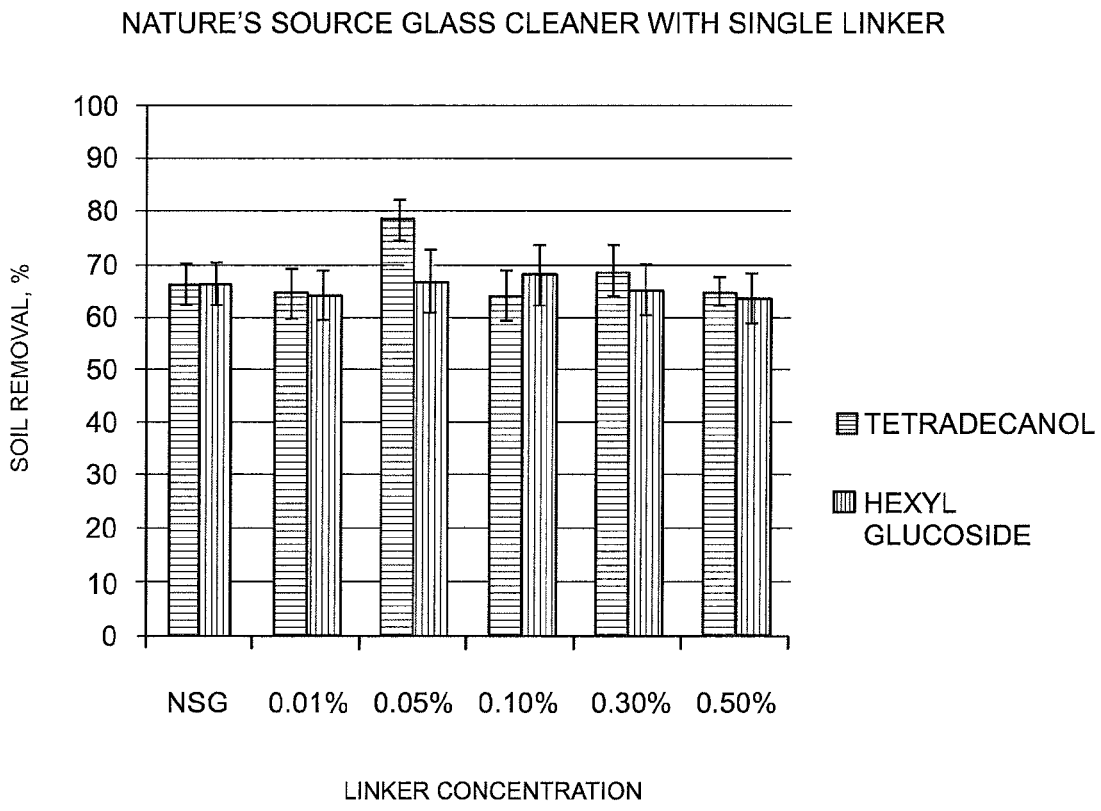
FIG. 4 graphically illustrates the relationship between the soil removal performance and the linker concentration of glass cleaning compositions that include only a single linker.

Moreover, as illustrated in FIG. 4, no significant improvement in soil removal performance of a glass cleaning composition is observed with the addition of either the lipophilic linker (tetradecanol) or the hydrophilic linker (hexyl glucoside) linker, except for tetradecanol at a concentration of 0.05 wt %.

Figure 5:
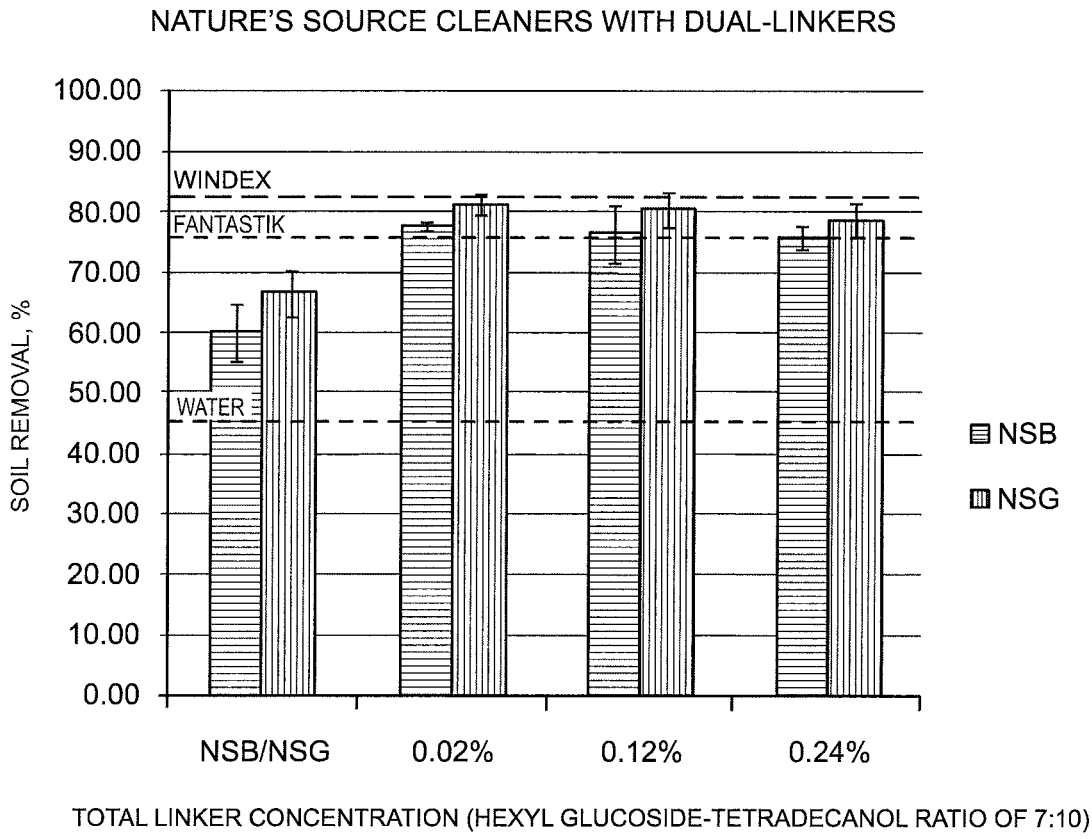
FIG. 5 graphically illustrates the synergistically improved soil removal performance of cleaning compositions that include dual linkers.

With the inclusion of both hydrophilic and lipophilic linkers ("dual linkers"), however, significant improvement in soil removal is observed in both bathroom (NSB) and glass (NSG) cleaning composition at a concentration range of 0.02 wt % to 0.24 wt %, as illustrated in FIG. 5. In fact, the soil removal performances of the cleaning compositions with dual linkers are comparable to the Windex® cleaning product or Fantastik® cleaning product.

Figure 6:
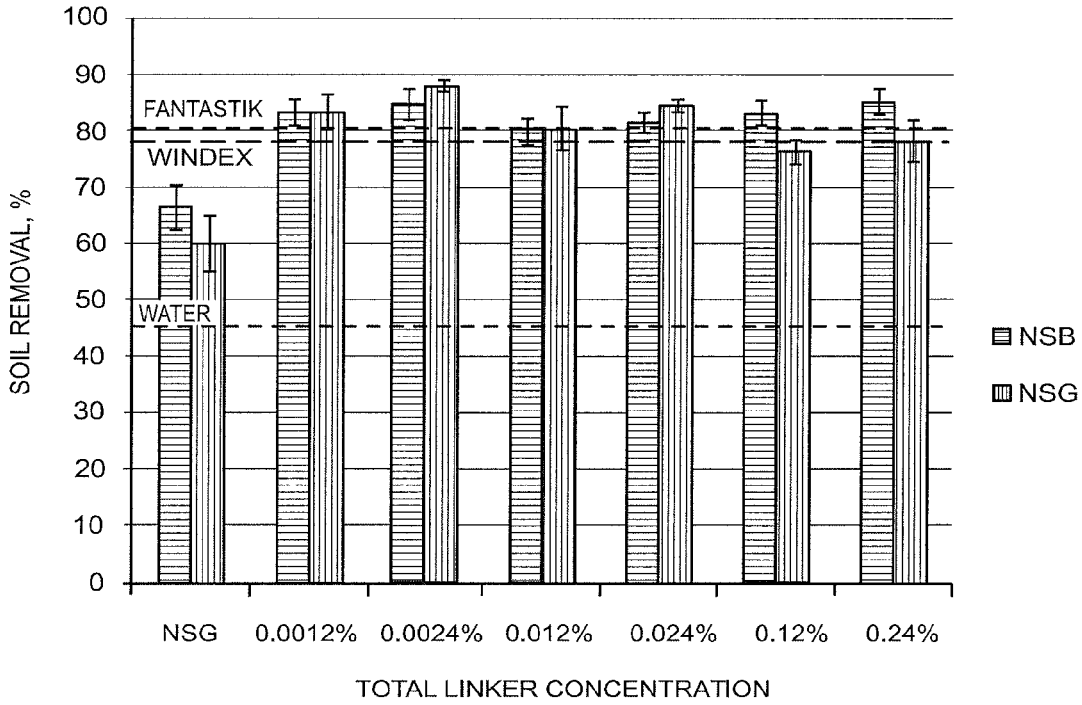
FIG. 6 graphically illustrates the relationship between the soil removal performance and the total linker concentration of cleaning compositions that include dual linkers.

Further, as illustrated in FIG. 5, varying the total dual linker concentration from 0.02% to 0.24% unexpectedly shows insignificant impact of the soil removal performance of the bathroom or glass cleaning composition, which may indicate that the total dual linker concentration in the composition may be reduced to even lower levels without affecting cleaning performance thereof. As illustrated in FIG. 6, the total dual linker concentration of the cleaning composition may vary between 0.0012 and 0.24 wt % without significantly affecting the soil removal performance thereof.

Non-limiting exemplary cleaning compositions containing a synergistic mixture of green surfactant and green linkers are listed below.

Composition C (Glass Cleaner)

| Function/ Description | Chemical Name/Trade Name | Concentration (wt %) | Natural Index (NI) (%) |
|---|---|---|---|
| Solvent | Water | 95.58 | 95.58 |
| Organic solvent | Ethanol SDA 40B | 3.9 | 3.9 |
| green surfactant | Alkyl polyglycoside/ Glucopon ® 425N | 0.4 | 0.4 |
| green hydrophilic linker | Hexyl glucoside | 0.005 | 0.005 |
| green lipophilic linkerlinker | C12-C18 alcohol | 0.007 | 0.007 |
| pH adjusting agent | Sodium citrate | 0.05 | 0.05 |
| pH adjusting agent | Caustic soda, 50% (aq) | 0.01 | 0.01 |
| Fragrance | Fragrance | 0.05 | 0.05 |
| | | | 100 |

Composition D (Bathroom Cleaner)

| Function/ Description | Chemical Name/Trade Name | Concentration (wt %) | Natural Index (NI) (%) |
|---|---|---|---|
| Solvent | Water | 93.83 | 93.83 |
| green surfactant | Alkyl polyglycoside/ Glucopon ® 425N | 3.0 | 3.0 |
| green hydrophilic linker | Hexyl glucoside | 0.01 | 0.01 |
| green lipophilic linker | C12-C18 alcohol | 0.014 | 0.014 |
| Organic acid | L-lactic acid | 3.0 | 3.0 |
| Fragrance | Fragrance | 0.15 | 0.15 |
| | | | 100 |

The streak reduction performance of Composition C is evaluated by a panel on a scale of 0-5 with 0 indicating no streak. The evaluation reveals that Composition C has a Streak of 0.50 while a glass composition similar to Composition C but without the linkers has a Streak of 0.90. Thus, the inclusion of green linkers synergistically improves streak reduction performance of a glass cleaning composition that includes one or more green surfactants.

Finally, a cleaning composition comprising a green surfactants blend, e.g. sodium coco sulfate and alkylpolyglycoside may further include one or more green linkers to improve its soil removal and/or streak reduction performance. It is found that, cleaning performance of a composition with optimized green surfactants blend (30/70 sodium coco sulfate/alkylpolyglycoside and 1 wt % total surfactant concentration) may be further improved by at least about 5% by inclusion of the dual linkers at a concentration of either 0.02 wt % or 0.2 wt %.

INDUSTRIAL APPLICABILITY

The disclosed composition may be used in a wide variety of cleaning tasks including, but not limited to, bathroom cleaning (bathtubs, toilets, tiles, bathroom fixtures, mirrors, etc.), kitchen cleaning (countertops, hood vents, sinks, cabinets, etc.), and other general household cleaning (furniture, home fixtures, windows, etc.). Moreover, the composition may also be used in offices, stores, and other commercial or noncommercial establishments. Finally, the composition may be used to cleaning personal items such as automobiles, computers, etc.

The disclosed composition may be used with a wide variety of cleaning articles. As a non-limiting example, the composition may be used with Fresh Brush® bathroom cleaning systems currently marketed by S.C. Johnson to achieve excellent cleaning results.

While only certain embodiments have been set forth, alternatives and modifications will be apparent from the above description to those skilled in the art. These and other alternatives are considered equivalents and within the spirit and scope of this disclosure and the appended claims.

What is claimed is:

1. A cleaning composition comprising:

a green nonionic surfactant;

a green anionic surfactant;

a green hydrophilic linker and a green lipophilic linker; and water, wherein the composition has a Natural Index of at least 98%, wherein a volume ratio of the green nonionic surfactant to the green anionic surfactant is about 30/70, wherein the green hydrophilic linker and the green lipophilic linker form a self-assembly, wherein the total green linker concentration is no more than 0.1 wt %, and wherein the total surfactant concentration of the composition is no more than 0.1 wt %.

2. The composition of claim 1, wherein the composition has a total surfactant concentration of no more than 0.01 wt %.

3. The composition of claim 1, wherein the green nonionic surfactant comprises alkylpolyglycoside.

4. The composition of claim 1, wherein the green anionic surfactant comprises an alkyl sulfate.

5. The composition of claim 4, wherein the alkyl sulfate is sodium lauryl sulfate or sodium coco sulfate.

6. The composition of claim 1, further comprising a natural active selected from the group consisting of natural fragrances, natural insecticides, natural insect repellants, and natural oils, wherein the composition provides prolonged release of the natural active.

7. The composition of claim 1, wherein the composition is present as a micro-emulsion.

8. The composition of claim 1, wherein the green hydrophilic linker comprises hexyl glucoside.

9. The composition of claim 1, wherein the green lipophilic linker comprises a C12-C18 alkanol.

* * * * *